US010427770B1

(12) United States Patent
Guidry

(10) Patent No.: US 10,427,770 B1
(45) **Date of Patent: *Oct. 1, 2019**

(54) THRUSTER-AIDED STEERING SYSTEM

(71) Applicant: Luke Guidry, Larose, LA (US)

(72) Inventor: Luke Guidry, Larose, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/349,504

(22) Filed: Nov. 11, 2016

Related U.S. Application Data

(63) Continuation-in-part of application No. 14/872,562, filed on Oct. 1, 2015, now Pat. No. 9,527,565.

(60) Provisional application No. 62/059,689, filed on Oct. 3, 2014.

(51) Int. Cl.
*B63H 11/117* (2006.01)
*B63H 11/113* (2006.01)
*B63H 25/46* (2006.01)

(52) U.S. Cl.
CPC ..... *B63H 11/117* (2013.01); *B63H 11/113* (2013.01); *B63H 25/46* (2013.01); *B63B 2751/00* (2013.01)

(58) Field of Classification Search
CPC ..... B63H 11/117; B63H 11/113; B63H 21/21
USPC ..... 701/21
See application file for complete search history.

(56) References Cited

U.S. PATENT DOCUMENTS

| | | | | |
|---|---|---|---|---|
| 3,237,585 | A | 3/1966 | Winter | |
| 4,056,073 | A | 11/1977 | Dashew | |
| 4,522,141 | A | 6/1985 | Aker | |
| 5,016,553 | A | 5/1991 | Spencer | |
| 5,282,763 | A | 2/1994 | Dixon | |
| 5,642,684 | A | 7/1997 | Aker | |
| 6,325,010 | B1 | 12/2001 | Gruenwald | |
| 6,350,164 | B1 | 2/2002 | Griffith | |
| 2003/0137445 | A1* | 7/2003 | Van Rees | B63C 1/04 342/41 |
| 2009/0072084 | A1 | 3/2009 | Hankinson | |
| 2009/0111339 | A1* | 4/2009 | Suzuki | B63H 11/113 440/1 |
| 2011/0172858 | A1* | 7/2011 | Gustin | B63H 21/213 701/21 |
| 2012/0129410 | A1* | 5/2012 | Tyers | B63H 21/21 440/1 |

(Continued)

FOREIGN PATENT DOCUMENTS

FR 1441046 A 6/1966

OTHER PUBLICATIONS

Fleeting Up, retrieved from http://www.mcdermott.com/SiteCollectionDocuments/Pipeline%20-%20McDERMOTT%20vessel%20upgrades.pdf on Jul. 25, 2014, McDermott Today, pp. 30-36.

(Continued)

*Primary Examiner* — Anthony D Wiest
(74) *Attorney, Agent, or Firm* — Jones Walker LLP

(57) ABSTRACT

A vessel with auxiliary steering includes a vessel hull with a bow/stern centerline and a port and starboard side. The vessel has (i) a main propulsion unit including at least one propeller and at least one main rudder, and (ii) a secondary propulsion unit including at least one directional water jet thruster on each of the port and starboard side of the vessel hull. The water jet thrusters are configured to direct water outwardly and perpendicularly to the centerline of the hull, and a control system coordinates the direction of the main rudder and the flow direction of at least one water jet thruster.

10 Claims, 5 Drawing Sheets

(56) References Cited

U.S. PATENT DOCUMENTS

2015/0142227 A1* 5/2015 Stephens ..... G05D 1/0208
701/21

OTHER PUBLICATIONS

Shipbuilding 101, retrieved from http://comeroids.wikia.com/wiki/Shipbuilding_101 on Jul. 25, 2014, pp. 1-2.
OmniTHRUSTER, Marine Maneuvering and Propulsion Systems, retrieved from www.omnithruster.com/htbrochure.pdf on Jan. 15, 2015, pp. 1-4.

* cited by examiner

THRUSTER-AIDED STEERING SYSTEM

CROSS-REFERENCE TO RELATED APPLICATION

This application is a continuation-in-part of U.S. nonprovisional application Ser. No. 14/872,562 filed Oct. 1, 2015, which claims the benefit under 35 USC § 119(e) of U.S. Provisional Application Ser. No. 62/059,689 filed Oct. 3, 2014, both of which are incorporated by reference herein in their entirety.

BACKGROUND OF INVENTION

The present invention relates to steerage and propulsion of maritime vessels, with particular embodiments relating to steerage of towboats.

Towboats or push-boats are specialized tugs often used in inland or coastal waterways to propel a series of unpowered barges. As one example, the towboat 1 shown in FIG. 1 is pushing two barges 100 in-line, but it is common for a towboat to push additional barges both in-line and side-by-side. Because the navigation channels of inland waterways are often narrow with comparatively sharp bends (especially in relation to a lengthy chain or "tow" of barges), precision steering is of the utmost importance. FIG. 1 suggests one problem encountered where a turn (to port in FIG. 1) results in the stern of towboat 1 moving in the starboard direction (i.e., "sliding") to a much greater degree than the head of the tow. This excessive slide can be problematic from the standpoint of the towboat stern moving outside the navigation channel or striking other nearby objects/vessels. Techniques for enhancing vessel steerage offer considerable advantages in this industry.

DETAILED DESCRIPTION

Figure 1:
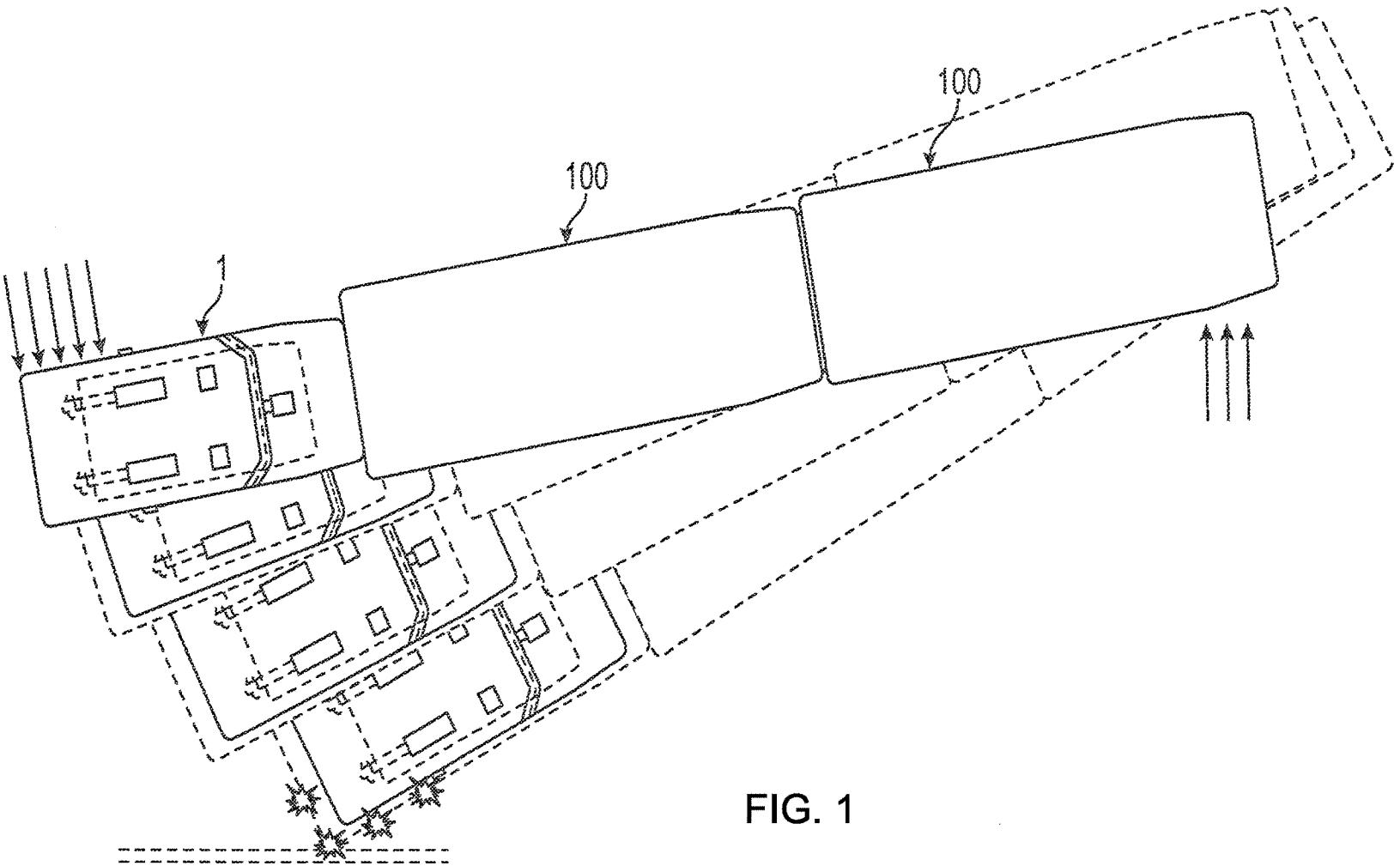
FIG. 1 illustrates a towboat pushing a series of barges.
Figure 2:
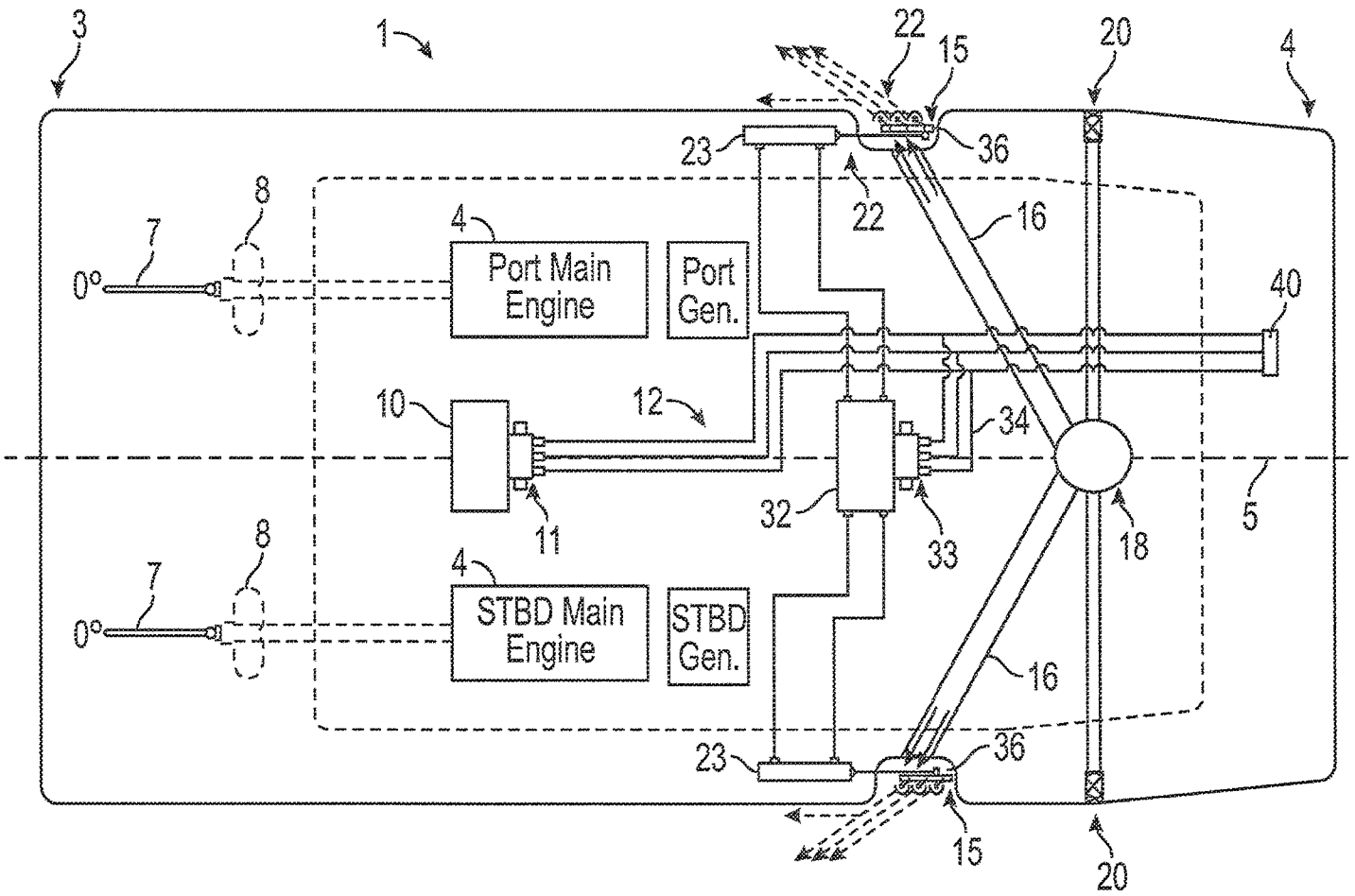
FIG. 2 illustrates a vessel layout for one embodiment of the present invention.

One embodiment of the present invention is a vessel with an auxiliary steering system as suggested in FIG. 2. FIG. 2 illustrates a towboat 1 having the stern 3, bow 4, and a centerline 5. The main propulsion and steering elements of towboat 1 include a main propulsion unit formed of two main engines 4 driving propellers 8 (sometimes also referred to as "screws" or "wheels"). A main rudder 7 is associated with each propeller 8 with the power for operating the main rudders being supplied by the rudder hydraulic unit 10. Naturally, other embodiments could utilize a single main engine/rudder or more than two main engines/rudders. The directional valves 11 direct the flow of hydraulic fluid to position the rudders 7 with control lines 12 connecting the directional valves to pilothouse steering controls 40.

In the illustrated embodiment, the auxiliary steering system includes a secondary propulsion unit formed by at least one directional water jet thruster 15 on each of the port and starboard side of towboat 1. The water jet thrusters generally consist of a engine/pump assembly (referred to as a "thruster engine") 18 taking in water from thruster intakes 20 and directing the water at high pressure through thruster pipes 16 through the thruster steerage assembly 22. In the illustrated embodiments, it is thruster steerage assembly 22 which provides the direction component to the water jet thrusters. The FIG. 4A embodiment of thruster steerage assembly 22 includes the thruster housing 25 which contains three rudders 26 capable of rotating within housing 25 on rudder shafts 31. Rudder links 27 connect on one end to shafts 31 and are rotatively pinned on their other end to jockey bar 28. The drive link 29 is pinned on one end to jockey bar 28 and to connector block 30 on its other end. The ram 39 of double-acting piston and cylinder assembly 23 engages connector block 30 and the fluid lines 24 supply the hydraulic fluid for extending and retracting the ram 39. Thus, it can be envisioned how extension and retraction of the ram 39 acts through the above described linkage to rotate the rudders 26. The angle through which thruster rudders 26 rotate may vary in different embodiments.

Figure 4A:
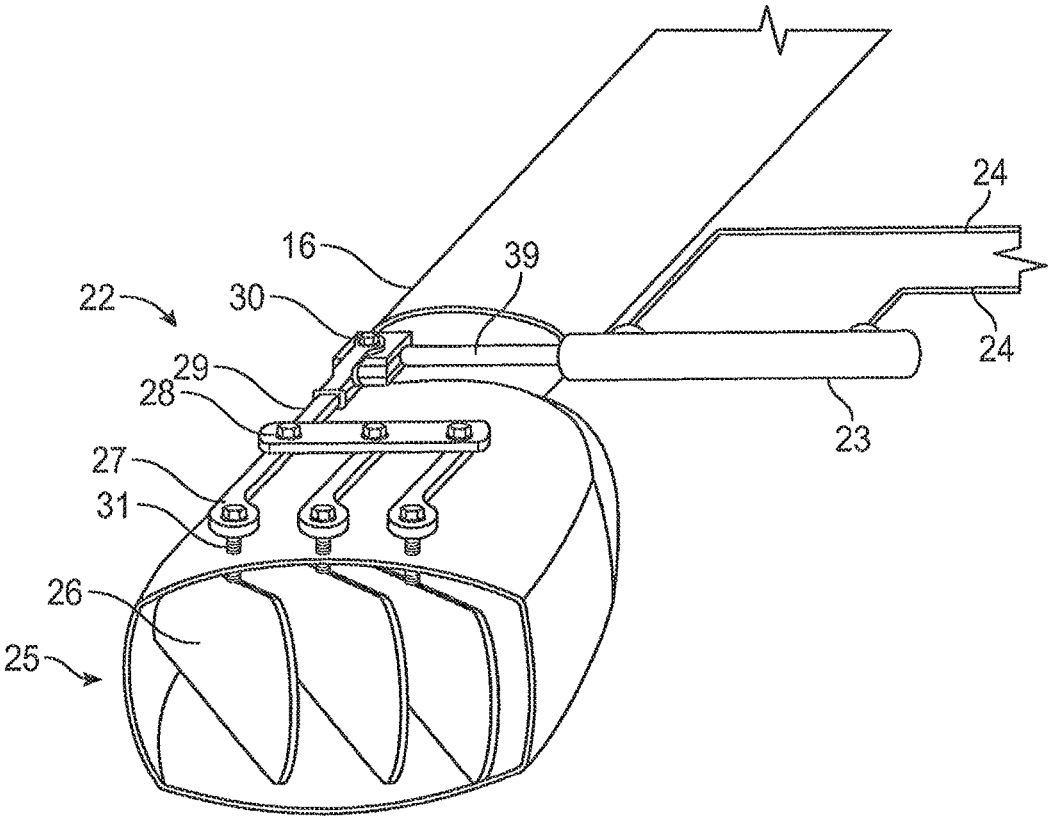
FIG. 4A illustrates one embodiment of the thruster steering assembly.
Figure 4B:
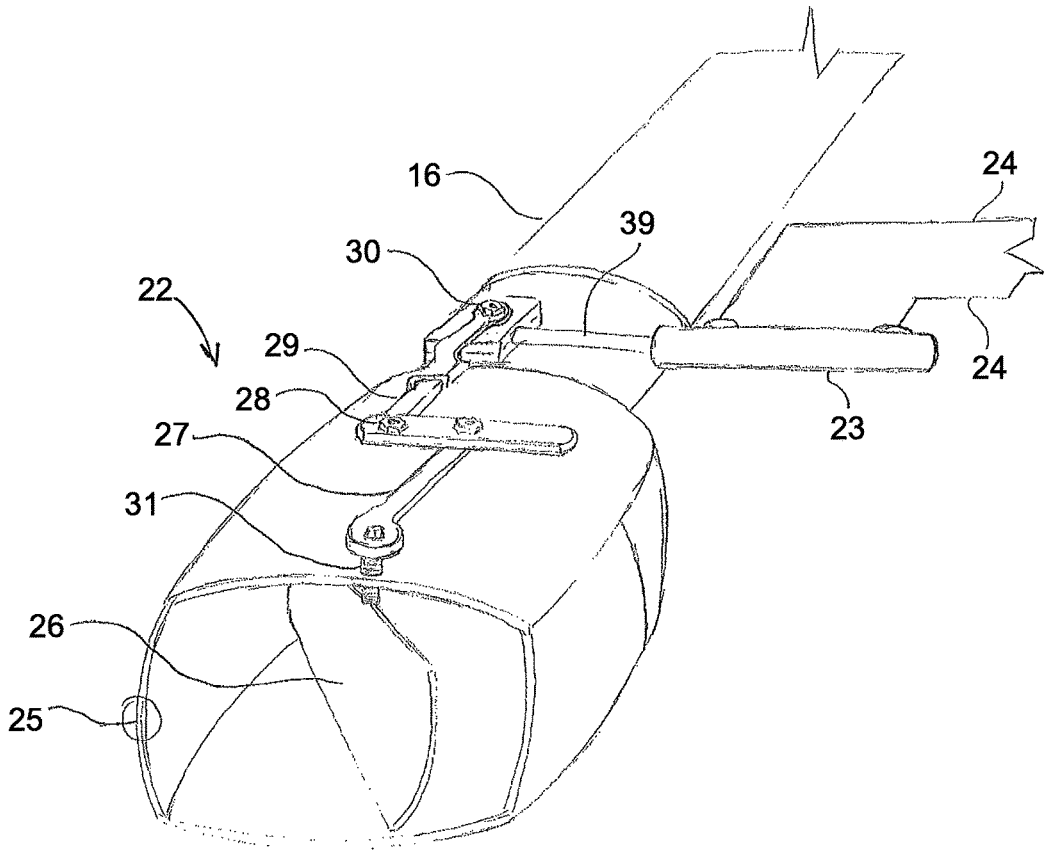
FIG. 4B illustrates a second embodiment of the thruster steering assembly.

Although FIG. 4A illustrates a thruster steerage assembly having multiple rudders 26, FIG. 4B illustrates an alternate embodiment where the thruster steerage assembly has only a single rudder 26. The position of single rudder 26 would be controlled in the same manner as described in regards to FIG. 4A with the steering linkages being driven by piston and cylinder assembly 23. Moreover, while not explicitly illustrated in the drawings, the water flow direction of the jet thrusters could be controlled by thrusters having no rudders. For example, the water flow direction could be controlled by the entire thruster housing 25 (absent rudders) pivoting from a position directing water flow perpendicular to the bow/stern centerline to a position directing water flow predominantly aft.

In the FIG. 2 example, the rearmost angle of thruster rudders 26 is 22.5°, i.e. the rudders 26 direct water from thruster engine 18 rearward at an angle of 22.5° relative to the centerline 5 of towboat 1. When the thruster rudders 26 are at an angle of 90°, they direct water outwardly from the hull perpendicular to centerline 5. At angles of over 90° (e.g., is 90° to) 157.5°, thruster rudders 26 direct water forward, i.e., placing reverse thrust on towboat 1. In the illustrated embodiment, the thruster rudders are positioned within inset 36 on the side of the hull. Preferably, the insets 36 will be sufficiently deep such that the thruster rudders do not extend beyond a side plane of the hull at any point during their operation. Alternatively, the thruster rudders will not extend beyond the side plane of the vessel hull when the thruster rudders are in their rearward position (i.e., 22.5° in the FIG. 2 example). However, the foregoing does not necessarily preclude the thruster rudders from extending beyond the side plane of the vessel in certain specialized embodiments.

Returning to FIG. 2, it may be seen how thruster hydraulic supply 32 provides hydraulic fluid to operate the piston and cylinder assemblies 23. The thruster directional valves 33 control fluid flow to the piston and cylinder assemblies 23 and directional valves 33 are in turn connected to the pilothouse steering controls 40 via control lines 34. It can be visualized from the control line arrangement of FIG. 2 that when pilothouse steering controls 40 provide steering input to the main rudders, the same signals may provide steering input to the thruster rudders 26. A control system acting on directional valves 33 and 11 to synchronize the relative position of main rudders 7 to thruster rudders 26 may be implemented by many different conventional or future developed methods. Nonlimiting examples include electrical relay networks or a programmable logic controller controlling directional valves 33 and 11.

Although not explicitly shown in the Figures, certain embodiments of thruster engine 18 may include a flow control or flow divider valve which selectively directs a greater portion of the pumped water from thruster engine 18 to one thruster pipe 16 (e.g., the port thruster pipe) than the other (e.g., starboard) thruster pipe 16, thereby producing greater thrust at the port thruster than the starboard thruster. However, in other embodiments, the water flow may be fixed and equally divided between the two thrusters. Likewise, many different conventional or future developed thruster engines may be employed. In one embodiment, the power rating of thruster engine 18 will be approximately 15% to 30%, and more preferably 20% to 25%, of the vessel's main engine power. For example, if the main engine(s) were rated for 1,800 HP, the thruster engine could be rated for approximately 400 to 500 HP. However, thruster to main engine power ratios could also be outside the ratios given above.

In the illustrated embodiment, the thrusters 15 are located along the port and starboard side of the hull at approximately the "pivot point" or "pivoting point" of the vessel. In many embodiments, the pivot point may be defined as the point of contact between the turning circle and the middle line of a vessel. It is situated forward of midships, the distance being greatest in vessels having the least resistance to lateral drift. The position of the pivot point varies in different vessels and also at different points of the turn. It depends upon the underwater form of the hull and especially upon the comparative draft forward and aft, and also upon the distribution of weights. In most vessels, the pivot point may be taken as two-third to five-sixth of the vessel's length from the stern.

Figure 3:
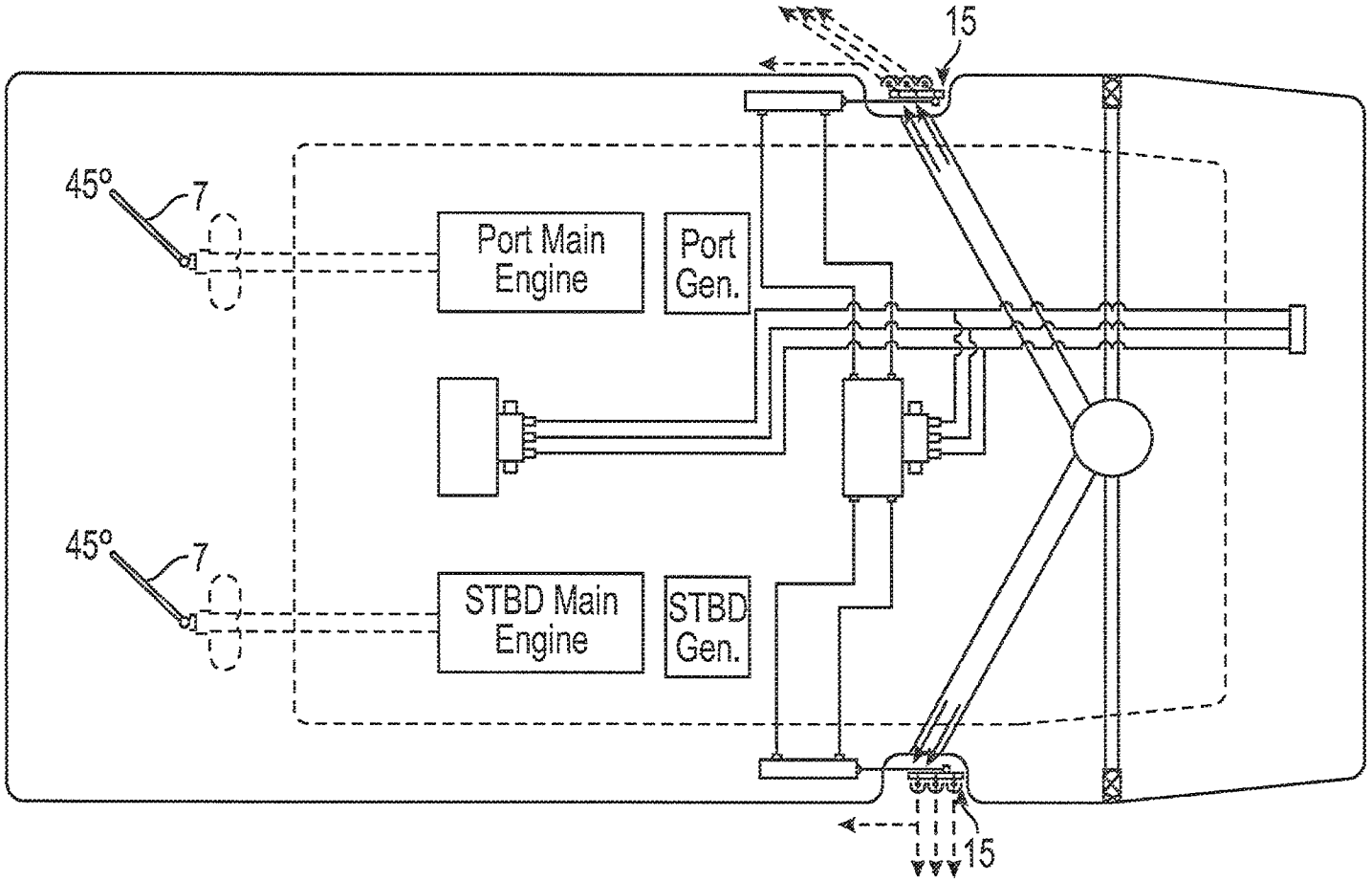
FIG. 3 illustrates the vessel of FIG. 2 steering to port.

As suggested above, many embodiments of the present invention will link selective control of the port or starboard thruster rudders 26 to the control of main rudders 7. FIG. 3 illustrates one example of relative position of the thruster rudders in relation to the main rudders. In FIG. 3, main rudders 7 are shown as having moved to 45° port rudder. Simultaneously, the steering control system has moved starboard thruster rudders 26 to the 90° position while maintaining port thruster rudders 26 at their rearmost position of 22.5°. The effect of the starboard thruster delivering thrust in the direction shown will be to lessen starboard stern slide of towboat 1 as towboat 1 and its tow execute a turn to port. In the example of FIG. 3, it is the thruster 15 opposite the direction of turn which adjusts its flow direction. In other words, when main rudders 7 turn to port, starboard thruster 15 adjusts its flow direction and when main rudders 7 turn to starboard, port thrusters 15 adjusts its flow direction. Additionally, in this example, the ratio of main rudder direction to thruster rudder direction will be approximately 1:2 for most main rudder positions under 45°. For clarity, Table 1 gives a series of main rudder directions and the corresponding direction of the port and starboard thruster direction.

TABLE 1

| Main Rudder Angle | Port Thruster Angle | STBD Thruster Angle |
|---|---|---|
| 0° | 22.5° | 22.5° |
| 11.5° Port | 22.5° | 45° |
| 22.5° Port | 22.5° | 67.5° |
| 45° Port | 22.5° | 90° |
| 11.5° STBD | 45° | 22.5° |
| 22.5° STBD | 67.5° | 22.5° |
| 45° STBD | 90° | 22.5° |

Thus, at 11.5° port main rudder, 22.5° of starboard thruster angle is added to the initial thruster angle of 22.5°. It can be seen from table 1 that this ratio is maintained until the thruster angle reaches 90°, which is the maximum thruster rudder angle in this example. Naturally, there may be other embodiments where the maximum thruster angle exceeds 90°, for example when applying astern propulsion or when in particular vessel maneuvering situations. Likewise, the ratio of main rudder direction to thruster direction is not limited to 1:2 and in other embodiments may range anywhere between 1:1.5 and 1:2.5 (or even ratios outside this range).

In addition to use of the thrusters 15 to reduce stern slide in turns, the operation of the thrusters in their rearward position (e.g., 22.5° in FIG. 2) can provide certain hydrodynamic efficiencies when the towboat is moving in a generally straight line at normal towing speeds (e.g., approximately four to eight miles per hour). It is believed that the bow moving through water at normal towing speeds creates a semi-circular flow which directs water back toward the stern of the boat and tends to draw surface air into the propeller area, thereby reducing the propulsion efficiency of the propellers. However, if the thrusters 15 are directing water rearward along the side of the hull, this thruster flow will tend to disrupt the semi-circular flow and prevent the drawing of air under the stern and potentially implode air bubbles that would otherwise be drawn into the propellers.

The main propulsion unit of the towboats described above may vary considerably in horsepower, with smaller canal towboats being in the 200 to 600 horsepower range and some larger river towboats being in excess of 10,000 horsepower. However, the auxiliary steering system described herein may have application to many different types of vessels, regardless of main propulsion horsepower rating or the intended use of the vessel.

The term "about" when used before a numerical designation, e.g., temperature, time, amount, and concentration, including range, indicates approximations which may vary by (+) or (−) 20%, 15%, 10%, 5% or 1%. Although the present invention has been described in terms of specific embodiments, those skilled in the art will recognize many obvious modifications and variations. All such variations and modifications are intended to come within the scope of the following claims.

The invention claimed is:

1. A method of operating a vessel wherein the vessel comprises (i) a main propulsion unit including at least one propeller and at least one main rudder, (ii) a secondary propulsion unit including at least one directional water jet thruster on each of a port and starboard side of a hull of the vessel, the jet thrusters configured to control a water flow direction; and (iii) a control system coordinating a position of the main rudder to the water flow direction of the jet thrusters, the method comprising the steps of:

(a) operating the main propulsion unit to impart a forward speed to the vessel of at least five knots; (b) operating the jet thrusters to direct thrust predominantly toward the stern of the vessel; and (c) subsequently applying left rudder and changing the direction of thrust of the starboard water jet thruster 1.5 to 2.5 times more than a change in left rudder.

2. The method of claim 1, wherein the water jet thrusters direct thrust between 10° and 35° of a bow/stern centerline of the vessel prior to step (c).

3. The method of claim 1, wherein the change in direction of thrust of the starboard jet thruster is approximately twice the change in left rudder.

4. The method of claim 1, wherein the water jet thrusters are located approximately ⅔$^{rd}$ of a length of the hull from a stern of the hull.

5. The method of claim 1, wherein each jet thruster includes at least one thruster rudder to control the water flow direction.

6. The method of claim 5, wherein a double acting piston acts to adjust a position of the thruster rudders.

7. The method of claim 1, wherein the secondary propulsion unit includes a flow divider capable of adjusting relative flow between the port and starboard jet thrusters.

8. The method of claim 6, wherein the thruster rudders are positioned within an inset on the hull such that the thruster rudders have at least one position not extending beyond a side plane of the hull.

9. The method of claim 1, wherein the power of the secondary propulsion unit is between about 15% and about 30% of the main propulsion unit.

10. The method of claim 9, wherein the main propulsion unit is between 200 and 15,000 horsepower.

* * * * *